US005104331A

United States Patent [19]

Goble

[11] Patent Number: 5,104,331

[45] Date of Patent: Apr. 14, 1992

[54] DAMAGE RESISTANT LATCHING ELECTRICAL CONNECTOR

[76] Inventor: Robert H. Goble, 4736 Edison St., San Diego, Calif. 92117

[21] Appl. No.: 743,900

[22] Filed: Aug. 12, 1991

[51] Int. Cl.[5] ..... H01R 4/50

[52] U.S. Cl. ..... 439/341; 439/371; 439/376; 439/490

[58] Field of Search ..... 439/345, 350, 352, 351, 439/355, 357, 358, 376, 341, 371, 519, 490

[56] References Cited

U.S. PATENT DOCUMENTS

| | | | |
|---|---|---|---|
| 1,123,074 | 12/1914 | Bliss | 439/376 |
| 3,171,704 | 3/1965 | Meile | 439/341 |
| 3,984,169 | 10/1976 | Armstrong et al. | 439/341 |
| 4,838,806 | 6/1989 | Igarashi | 439/376 X |

*Primary Examiner*—Neil Abrams
*Assistant Examiner*—Khiem Nguyen
*Attorney, Agent, or Firm*—Frank D. Gilliam

[57] ABSTRACT

A connector for electrical cables having a mechanism to prevent inadvertent disconnection. The connector includes a substantially solid block female component having a housing containing a concave, surface of revolution, curved surface with a plurality of electrical contacts on that surface and a substantially solid block male component having a housing containing a convex, corresponding surface of revolution, curved surface with a plurality of electrical contacts on that surface. One of those housings includes a pin spaced from and substantially parallel to the axis of the surface of revolution. The other housing typically has a pair of spaced notches in the housing at a corresponding distance from and substantially parallel to the axis of its surface of revolution. Thus, the notches can be engaged with the pin and the housings relatively rotated to bring the concave and convex surfaces and their associated electrical contacts into a wiping engagement. A releasable latch means is provided between the housings opposite the pin and notch. Electrical cables connected to the contacts enter the housings in the plane of the pin, so that the connector will not open in response to pulls on the cables. A light or lights may be provided to indicate that the connector or connectors are live. The engaging edges of the closed connector can be taped to prevent access of liquids to the contacts.

18 Claims, 1 Drawing Sheet

DAMAGE RESISTANT LATCHING ELECTRICAL CONNECTOR

BACKGROUND OF THE INVENTION

This invention relates in general to electrical connectors and, more specifically, to latchable electrical connectors that are resistant to inadvertent separation and impact or crushing damage.

A wide variety of electrical connectors have been developed to connect electrical cables together, to connect cables to equipment, etc. Several standard connectors have been developed for use with different voltage and current levels. Typically, these have several differently shaped and spaced prongs on one component that slip into correspondingly configured sockets on a second component. While effective in normal household use, these are less than fully effective in many applications and environments.

Where extensive use of extension cables is required, such as in the construction industry, in lighting motion picture or video sets, etc., connectors may be subject to forces tending to pull them apart and to environmental conditions that can contaminate the connector or prongs with water or other materials. Also, these connectors are subject to damage to prongs when disconnected, such as by having prongs bent or damaged by persons stepping on them, being run over by vehicles and the like. When the prongs are contaminated, or where the connector is not fully connected, intermittent short circuits between prongs or intermittent open circuits may occur, which are often very difficult to detect and repair. Further, partially inserted prongs may allow the circuit to function, but may allow metallic contamination to touch the prongs causing short circuits or even fires. There is even a possibility of electrocution where a person handling cables comes into contact with prongs that are not fully inserted, particularly on outdoor, possibly wet, construction sites or the like.

Attempts are made to reduce these problems and dangers by knotting the cables together adjacent to the connection or apply clamping devices to hold the connection together. Knotted cables are cumbersome and provide projections over which people may trip and stumble. The clamps, while sometimes effective, are also large and cumbersome an capable of failure if not properly used.

Many connectors are hollow and relatively fragile and subject to damage if subjected to impact or crushing, such as when construction material is dropped on a connector or it is run over by a vehicle.

A number of special connectors have been developed in attempts to overcome these problems. For example, Armstrong et al. in U.S. Pat. No. 3,984,169 disclose a complex keying arrangement in which one component is pivoted about a swivel pin to bring a coded arrangement of blades and slots into mesh to connect a cable to a power distribution panel. A separate latch mechanism is required to keep the unit connected. While useful in this special application, this arrangement has little utility in normal cable to cable or cable to outlet connections.

Meile in U.S. Pat. No. 3,171,704 discloses an electrical connector made up of a first hollow box having a concave surface at one end on which several electrical contacts are formed and a second hollow box having a thin extended finger having a convex surface corresponding to the concave first surface, with three complementary contacts on the convex surface. These two surface are pivoted into contact about a pin to make a connection that cannot be separated by a straight line pull. While effective for many purposes, this connector is undesirably fragile for use in difficult environments. For example, the boxes will be subject to breaking, cracking or crushing if stepped upon or run over be vehicles with hard wheels. The thin sleeve that covers the unit when assembled may crack and expose the pivoting hooks that are part of the conductor system. The thin convex conductor member is liable to bend or break, causing at least intermittent loss of continuity and possible danger when used in a hazardous atmosphere.

Thus, there is a continuing need for improved electrical connectors for use in circumstances such as where a number of connected cables are connected across floors or roadways, such as in construction, lighting, or in emergency applications such as natural disaster relief work. Connectors are necessary that cannot be separated by straight line pull, and will not be damaged or cause electrical hazards when subjected to abuse.

SUMMARY OF THE INVENTION

It is, therefore, an object to provide a connector for electrical cables that overcomes the above-noted problems. Another object is to provide a connector that prevents inadvertent separation of the connector by a straight line pull on the cables. A further object is to provide a connector that is highly resistant to impact and crushing damage. Yet another object is to provide a connector that holds the electrical contacts in pressure engagement. Still a further object is to provide a connector in which the electrical contacts are housed so as to prevent inadvertent contact with outside bodies or liquids.

The above-noted objects, and others, are accomplished in accordance with this invention by an electrical connector that includes a substantially solid block female component with a housing having a concave curved surface with a plurality of electrical contacts on that surface and a substantially solid block male component with a housing having a convex curved surface with a plurality of electrical contacts on that surface.

The curved surfaces are preferably corresponding surfaces of revolution permitting the convex surface to nest against the concave surface. The electrical contacts are preferably elongated and lie on the surfaces radially around the axes of the surfaces. The contacts are staggered so that the ground contacts come into contact first as the connector is connected. Preferably the contacts lie at an approximately right angle to the supporting surface and are curved so as to wipe against each other as contact is made.

A pin secured to one of the housings and positioned on the axis of that curved surface cooperates with notch means on the other housing positioned on the axis of that curved surface to allow the two surfaces to rotate together with the electrical contacts in sliding engagement.

For optimum effectiveness, the contacts on one surface are positioned on raised lands and the contacts on the other surface are positioned in corresponding grooves. Thus, as the surfaces are rotated into the closed position, the lands will enter the grooves and prevent axial misalignment and will help prevent distortion of the closed housings due to impacts or stress imposed on the closed housing, such as being run over by a vehicle or the like.

Any suitable material can be used for the bodies of the male and female components. Typical materials include metal, plastics, synthetic or natural rubber, rigid or semi-rigid foam, ceramics, wood and combinations thereof. Best results are obtained where the internal, electrical contact supporting, bodies are formed from semi-rigid plastic foams, such as polyurethane, polyimide and polyamide foams and combinations or mixtures thereof. These foam materials provide high strength-to-weight ratios, ease of manufacturing by foam-in-mold techniques, excellent electrical insulation properties, superior resistance to impact and crushing forces, and sufficient resilience to assure that the contacts are maintained in pressure contact when the connector is closed. Semi-rigid polyurethane foam has optimum properties for this connector.

If desired, the internal body may form the entire structure, often with an exterior skin formed during the foaming operation. Also, the block and housing could be formed as a unitary structure from a plastic material by any conventional method, such as injection molding. Alternatively, an external housing or shell may be provided for added strength. Any suitable material may be used, such as metal or high strength plastics. The shell may be fabricated by any conventional method. Where a plastic material, such as a polycarbonate, acrylic, polyimide or the like, is used, the shell can be made by conventional injection molding techniques, then a plastic foam may be foamed in place, using the shell as part of the mold and assuring excellent bonding between shell and foam. The electrical contacts and connecting wires will preferably be placed in the mold and will be bonded to the foam during the foaming step, providing a high strength, well bonded final assembly.

A spring loaded latch is preferably provided to lock the male and female components together, although the connector is unlikely to come apart inadvertently in use without a latch, especially where the cables enter the male and female components in the plane of the pin, so that a straight line pull on the cables will not cause the components to rotate apart. In wet weather, it may be desirable to wrap a layer of conventional duct tape or the like around the contacting edges of the components to help prevent water penetration.

In order to show that the connector is "live", a small signal light, such as a light emitting diode, may be provided on the exterior of the housing, connected across the hot and ground contacts.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
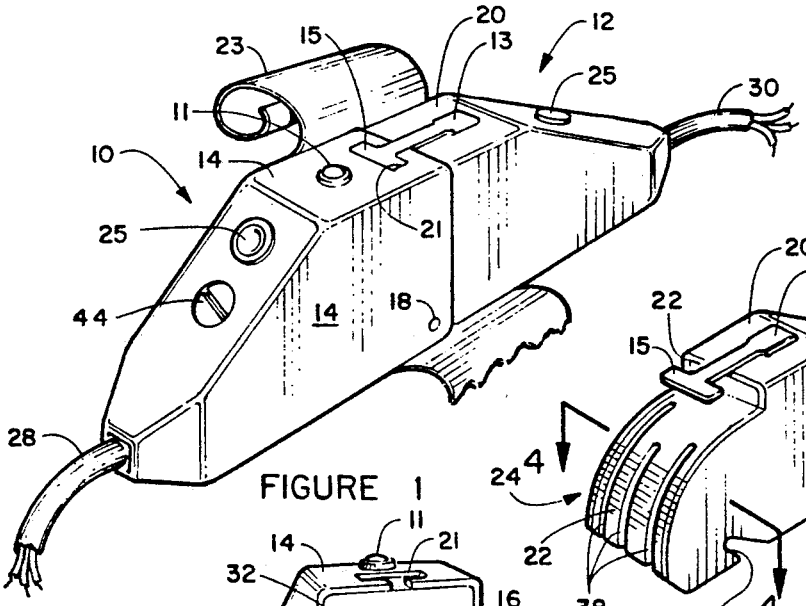
FIG. 1 is a side perspective view of the connected male and female connector components.

Referring now to FIG. 1, there is seen a female connector component 10 and a male connector component 12. Component 10 and 12 include external housings 14 and 20. Multi-conductor cables 28 and 30 enter housings 14 and 20, respectively, substantially in line with pin 18, so that the components cannot be inadvertently separated by pulling on the ends of cables 28 and 30, as detailed below.

A spring latch 13 (as best seen in FIGS. 1, 2, 5 and 6) having an enlarged, here "T" shaped, head 15 and a spring end 19 hingedly attached to housing 20 cooperates with a corresponding "T" shaped notch 21 in housing 14 to hold the connector in the closed position. To open the latch, the end of pivot lever 11 is pressed downward causing the opposite end to press against the under surface of end 15 against the bias of spring at end 19, causing head 15 to be forced up and out of notch 21, allowing male component 12 to be rotated about pin 18 to open the connector.

Tape 23 may be wrapped around the meting edge of components 10 and 12 to prevent the entry of water in wet weather. A light 25, such as a light emitting diode, described in detail below, may be mounted on either housing 14 or 20 or both, as shown, with leads to the ground and hot connection, to signal that the connector is in operation.

Figure 2:
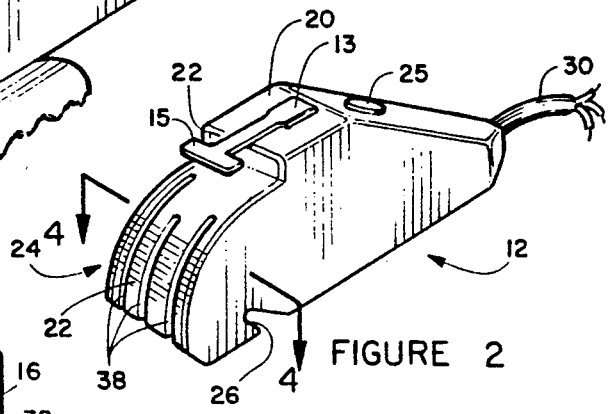
FIG. 2 is a perspective view of the connector male component.
Figure 3:
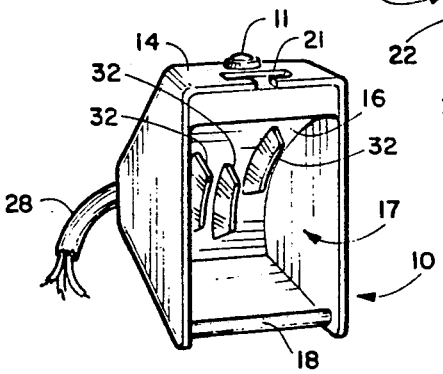
FIG. 3 is a perspective view of the connector male component.

As seen in FIG. 2, male component 12, within housing 20, contain a block 22 substantially filling the housing and having a convex surface 24 that is a surface of revolution substantially conforming to concave surface 17 of female component 10, as seen in FIG. 3. A pair of notches 26 in housing 20 have a width conforming to the diameter of pin 18, with the bottom of the notch lying at the axis of the convex surface.

Conventional electrical cables 28 and 30 enter the ends of blocks 16 and 22, respectively, opposite the curved surfaces in line with pin 18. Wires within these cables are connected to contacts on the curved surfaces, as detailed below. The cables may be secured to housings 14 and 20 by conventional cable clamps attached to the housings, if desired. Alternatively, the cables could be molded with, or adhesively bonded to, the housings and/or blocks during manufacture to form a unitary structure. For example, the housing could be placed in a mold having a mold wall corresponding to the concave or convex block surface, contacts could be mounted on that mold wall, with cable leads extending through the block region and soldered to the contacts. A foamable material could be placed in the mold to expand, forming a solid block well bonded to the housing, contacts and cable components.

Alternatively, housings 14 and 20 could be formed integrally with blocks 16 and 22, respectively, depending upon the material (such as a solid injection moldable plastic) chosen for those portions. In the embodiment shown, however, housings 14 and 20 are formed from metal, high strength plastic or the like and blocks 16 and 22 are semi-rigid foam, such as a polyurethane foam which may be separately formed and inserted in the housings or, preferably, foamed in place.

Figure 4:
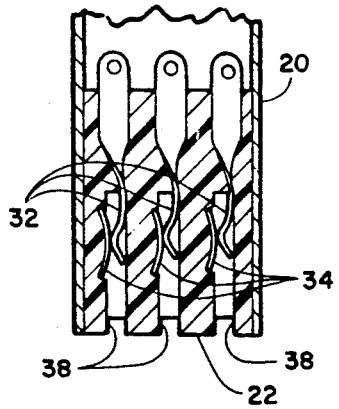
FIG. 4 is a section view taken on line 4—4 in FIG. 2.

FIGS. 2 and 3 show perspective views of the curved surfaces 17 and 24, showing the location of contacts 32 and 34, respectively. Contacts 32 preferably are positioned each on a side of a raised land 36 or extend along concave surface 17 above that surface, while contacts 34 are positioned at the sides of corresponding grooves 38. This cooperating set of lands and grooves helps assure proper transverse alignment of contacts 32 and 34 as the connector is closed. Preferably, there is a slight interference fit between the contacts 32 and 34 as the connector is closed, to assure tight, pressure contact between the contacts. This can be accomplished by slight resiliency in blocks 16 and 22 or by dimples or springy bent regions, as seen in FIG. 4, a section take on line 4—4 in Figure but with the connector closed, showing both contacts 32 and 34. As can be best seen in FIG. 3, one contact 32, that selected to be the ground contact, is positioned so that contact is engaged prior to engagement of the hot contacts.

Figure 5:
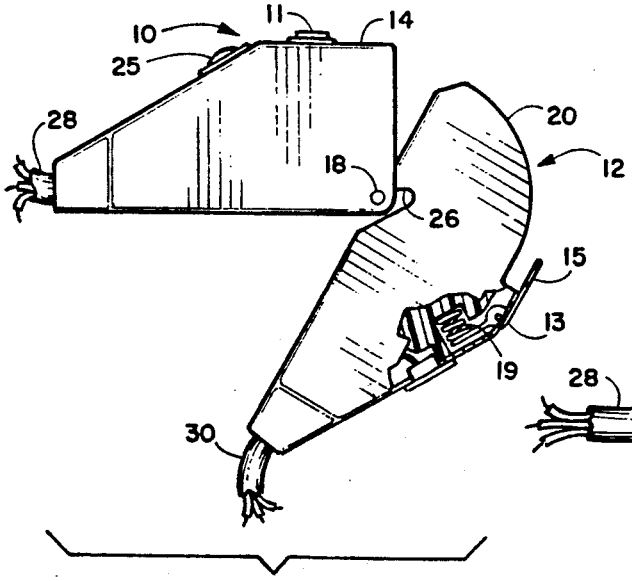
FIG. 5 is a side elevation view showing initiation of closing of the connector.

FIG. 5 illustrates the mating of the male and female connector components. As seen in FIG. 5, notch 26 in male component 12 is brought into engagement with pin 18 on female component 10 and male component 12 is rotated counter clockwise until the position shown in FIG. 4 is reached. The cooperating contacts on the components wipe against each other to assure a clean, effective electrical connection. When the connector is fully closed as seen in FIG. 4, pulling in opposite directions on cables 28 and 30 will not cause the connection to disengage. As the fully closed position is reached, head 15 on latch 13 enters the corresponding notch in housing 14. If the second end of cable 28 or 30 is connected to a power source, light or lights 25 will be illuminated.

Figure 6:
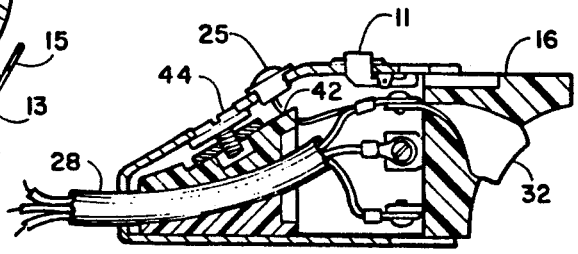
FIG. 6 is a side elevation view with the near housing side removed, of the connector of FIG. 3.

As seen in FIG. 6, a side view of female component 10 with the near wall of housing and a portion of the near structure cut away, cable 28 may be secured in place by a plastic or foam block 42 secured by bolt 44. Light 25 is connected between a hot wire and a ground wire. Contacts 32 may be in the form of a twisted metal strip, as seen.

When fully closed, the unit is nearly fully filled with the blocks 16 and 22. If desired, additional "foam-in-place" foam could be used to fill any remaining space within the housings. Thus, the connector is highly resistant to impact or pressure, such as might occur if a heavy object were dropped on the connector or if a wheeled vehicle ran over the connector. Still, the connector can be easily disengaged when necessary by simply rotating the male component 12 clockwise relative to female component 10.

Other applications, variations and ramifications of this invention will occur to those skilled in the art upon reading this disclosure. Those are intended to be included within the scope of this invention, as defined in the appended claims.

I claim:

1. A latching electrical connector comprising:

a female component comprising:

a first housing;

a first block substantially filling said first housing;

a concave curved surface on said first block, said surface being a surface of revolution;

a plurality of first electrical contacts on said concave surface;

a male component comprising:

a second housing:

a second block substantially filling said second housing;

a convex curved surface on said second block, said surface being a surface of revolution substantially conforming to the surface of revolution of said concave curved surface;

a plurality of second electrical contacts on said convex surface configured to contact said first electrical contacts when said concave and convex surfaces are brought together;

a first electrical cable entering said first housing from the side opposite said concave curved surface and electrically connected to said first electrical contacts;

a second electrical cable entering said second housing from the side opposite said convex curved surface and electrically connected to said second electrical contacts;

a pin secured to one of said first and second housings, spaced from and substantially parallel to the axis of said surface of revolution;

notch means on the other of said first and second housings, spaced from and substantially parallel to the axis of said surface of revolution; and said notch configured so that said notch may be brought into engagement with said pin and said housings relatively rotated to bring said concave and convex surfaces and associated electrical contacts into wiping engagement;

whereby said housings are closed together and can be separated only by reversing said relative rotation.

2. The electrical connector according to claim 1 further including a spring latch means for releasably connecting the sides of said housing opposite said pin when said connector is fully closed.

3. The electrical connector according to claim 1 wherein said first and second blocks are formed from a semi-rigid plastic foam material.

4. The electrical connector according to claim 3 wherein said plastic foam material is a polyurethane foam.

5. The electrical connector according to claim 1 wherein the electrical contacts on one of said blocks are positioned in grooves in said block and the electrical contacts on the other of said blocks are positioned on raised lands having heights substantially corresponding to the depth of said grooves, whereby axial misalignment of said connectors is prevented.

6. The electrical connector according to claim 5 wherein there is a slight interference fit between said blocks as they are brought into engagement whereby said blocks are slightly compressed to maintain said electrical contacts in pressure engagement.

7. The electrical connector according to claim 5 wherein said first electrical contacts are arranged substantially parallel to said second electrical contacts and include dimples adapted to resiliently wipe together as said connector is closed.

8. The electrical connector according to claim 1 wherein electrical cables enter said housings in a plane that includes said pin, whereby no forces tending to open said connector are generated by straight line pulls on said cables.

9. The electrical connector according to claim 1 further including a light on one of said housings connected between a hot and a ground contact.

10. The electrical connector according to claim 1 further including a strip of tape around the line of contact between said closed components whereby entry of liquids therebetween is substantially prevented.

11. A latching electrical connector comprising:

a female component comprising:

a first housing;

a first block substantially filling said first housing;

a concave curved surface on said first block, said surface being a surface of revolution;

a plurality of first electrical contacts on said concave surface;

a male component comprising:

a second housing:

a second block substantially filling said second housing;

a convex curved surface on said second block, said surface being a surface of revolution substantially conforming to the surface of revolution of said concave curved surface;

a plurality of second electrical contacts on said convex surface configured to contact said first electrical contacts when said concave and convex surfaces are brought together;

the electrical contacts on one of said blocks being positioned in grooves in said block and the electrical contacts on the other of said blocks being positioned on raised lands having heights substantially corresponding to the depth of said grooves;

separable hinge means on said first and second housings permitting said housings to be hingedly connected and rotated together to bring said concave and convex surfaces and associated electrical contacts into wiping engagement and said cooperating lands and grooves prevent axial misalignment of said electrical contacts.

12. The electrical connector according to claim 11 wherein said first and second blocks are formed from a semi-rigid plastic foam material.

13. The electrical connector according to claim 11 wherein said plastic foam material is a polyurethane foam.

14. The electrical connector according to claim 11 wherein there is a slight interference fit between said blocks as they are brought into engagement whereby said blocks are slightly compressed to maintain said electrical contacts in pressure engagement.

15. The electrical connector according to claim 11 wherein said first electrical contacts are arranged substantially parallel to said second electrical contacts and include dimples adapted to resiliently wipe together as said connector is closed.

16. The electrical connector according to claim 11 wherein electrical cables enter said housings in a plane that includes said hinge means, whereby no forces tending to open said connector are generated by straight line pulls on said cables.

17. The electrical connector according to claim 11 further including a light on at least one of said housings connected between a hot and a ground contact.

18. The electrical connector according to claim 11 further including a strip of tape around the line of contact between said closed components whereby entry of liquids therebetween is substantially prevented.

* * * * *